US006056506A

United States Patent [19]

Martin et al.

[11] Patent Number: 6,056,506

[45] Date of Patent: May 2, 2000

[54] PUMP ASSEMBLY FOR JETTED TUB

[75] Inventors: Thomas B. Martin, Placerville; Malcolm Clever, Anaheim, both of Calif.

[73] Assignee: Emerson Electric Co., St. Louis, Mich.

[21] Appl. No.: 09/159,207

[22] Filed: Sep. 23, 1998

[51] Int. Cl.[7] ..... F01D 1/02

[52] U.S. Cl. ..... 415/204; 415/172.1; 415/173.1; 415/173.5; 415/174.5; 415/206; 415/185; 415/208.2

[58] Field of Search ..... 415/58.2, 58.3, 415/58.4, 185, 186, 188, 182.1, 204, 206, 208.2, 172.1, 173.1, 173.5, 174.5

[56] References Cited

U.S. PATENT DOCUMENTS

| | | | |
|---|---|---|---|
| 3,402,671 | 9/1968 | Wilfley et al. | 415/168.2 |
| 5,156,522 | 10/1992 | Tessier | 415/58.2 |
| 5,156,535 | 10/1992 | Budris et al. | 417/423.7 |
| 5,408,708 | 4/1995 | Mathis | 4/541.4 |
| 5,451,139 | 9/1995 | Tadiello | 415/56.5 |
| 5,701,388 | 12/1997 | Steinhardt et al. | 392/471 |
| 5,930,852 | 8/1999 | Gravatt et al. | 4/541.1 |

*Primary Examiner*—Edward K. Look
*Assistant Examiner*—Ninh Nguyen
*Attorney, Agent, or Firm*—Howell & Haferkamp, L.C.

[57] ABSTRACT

A pump casing comprises an inlet conduit, a volute and a flow directing chamber. The inlet conduit has a first interior cross-sectional area. The volute has a hollow interior adapted to house a pump impeller. The flow directing chamber is positioned intermediate the inlet conduit and the volute. The chamber has a second interior cross-sectional area greater than the first interior cross-sectional area. The chamber has an inlet opening at a lower portion of the chamber and an outlet opening at an upper portion of the chamber. The inlet opening is in fluid communication with the inlet conduit. The outlet opening is in fluid communication with the volute. The outlet opening has a third interior cross-sectional area less than the second interior cross-sectional area. In another aspect of the pump casing, the inlet conduit has an upstream opening and a downstream opening and is adapted for directing a flow of fluid along a generally longitudinal linear first flow path from the upstream opening to the downstream opening. The outlet opening of the chamber is laterally offset from the first flow path. The chamber includes a front wall adjacent the inlet opening and a generally cylindrical peripheral wall extending from the front wall toward the volute. The front wall and peripheral wall are adapted to direct the flow of fluid received from the inlet conduit toward the outlet opening of the chamber along a generally linear second flow path that is generally parallel to the first flow path.

33 Claims, 6 Drawing Sheets

PUMP ASSEMBLY FOR JETTED TUB

BACKGROUND OF THE INVENTION

This invention pertains to pumps and, more particularly, to jet pumps used for circulating water in a jetted tub.

Jetted tubs are tubs that are outfitted with a pump for re-circulating the water in the tub. Typically, a pump takes water from the tub and re-circulates the water back into the tub through one or more jets, which are mounted on or in the tub. The jets are typically directed toward a portion of a tub user's body for recreational and/or therapeutic purposes. The user can aim the jets or position himself or herself in front of the jets. In some jetted tubs, air can be introduced into the jets along with the water to increase the therapeutic effectiveness of the jets.

Jetted tubs, are typically household sized bathtubs, as distinguished from larger sized hot tubs configured for simultaneous use by multiple users. For both types of tubs, bacterial growth is an important health problem. Typically, hot tub water is treated with chlorine or bromine to reduce the capacity of the water to support bacterial growth. However, a jetted tub is typically filled with minimally treated household water. While larger sized hot tubs are usually kept full of heated water, the smaller jetted tubs are usually drained after every use. It is therefore important that jetted tubs, including the pump and all of its associated plumbing, drain completely so as to leave no remaining water, which might support bacterial growth.

Centrifugal pumps are commonly used for re-circulating the water in a jetted tub because they are generally efficient, reliable, and low cost. A typical centrifugal pump comprises an electric motor that turns a generally disk-shaped impeller having an inlet opening near its center. When the impeller is rotated, water inside the impeller is also caused to rotate. The resulting centrifugal force of the water causes it to move from the center of the impeller near the inlet opening outwardly along vanes toward the perimeter of the impeller. Water exiting the perimeter of the impeller is collected by a generally annular volute, which channels the water to a pump outlet. Thus, the centrifugal force created by the impeller causes a pressure differential between the pump inlet and pump outlet, which causes water to flow through the pump. The flow of the pump is a function of both the speed of the motor and the size of the impeller. The faster the motor spins the impeller and the larger the diameter of the impeller, the greater the difference in pressure between the pump inlet and pump outlet.

FIG. 8 shows a typical prior art pump P. In a typical installation, the pump inlet I is connected to, and draws water from, the tub outlet or drain. The pump outlet (not shown) is connected to the one or more jets, which are typically mounted to the side walls of the tub. In a typical mode of operation, the user fills the tub with water and then turns on the pump. When finished, the pump is turned off and the tub is then drained. When a jetted tub is drained, the water in the various plumbing parts drains down into the pump outlet, backwards through the pump and out the pump inlet I to the tub drain. The lower half of a typical centrifugal pump casing is below the level of the centrally located pump inlet I and, therefore, water in the lower half of the pump casing is unable to drain out through the pump inlet I. To avoid leaving water in the lower half of the pump casing, which might support bacterial growth, typical pump casings include an extended, downwardly sloping inlet pipe E with a built-in offset, so that a bottom portion of the inlet pipe E is level with the bottom of the pump casing. A small bypass tube T connects the lower portion of the pump casing to the bottom portion of the inlet pipe E to allow water that would otherwise be trapped in the lower half of the pump casing to drain when the tub is drained.

Again, the flow of the pump is a function of both the speed of the motor and the size of the impeller. Typical prior art jet pumps are driven by an electric motor that operates at or above 3,000 rpm. When the pump is driven by an electric motor that operates above 3,000 rpm, the required flow can be achieved with a relatively small impeller. In such high-speed pumps, the volute and pump casing are relatively small and, accordingly, the necessary inlet offset is relatively small. A relatively small inlet offset can be easily molded into the front of the pump casing. In the molding process, the inlet pipe is typically "cored" by two pins, one from each side of the mold. The two pins are offset from one another by the necessary amount, but still meet in the middle with enough contact to create the necessary passage through the inlet pipe.

Noise is a common problem with jetted tubs that use such high-speed pumps. In general, fractional horsepower motors which operate at less than about 2,000 rpm are, for the same horsepower, less expensive and quieter in operation. The drawback to using a lower speed motor is that a larger impeller is required to maintain the same pump performance. A larger impeller requires a larger pump casing. The offset in the inlet pipe that is required to drain the pump casing also becomes larger and impossible to mold by the "coring" process described above. This is because the two pins would be offset from one another by too much to meet in the middle with enough contact to create the necessary passage through the inlet pipe. Consequently, the inlet pipe must be constructed in two pieces that need to be first assembled to one another, and then assembled to the rest of the pump casing.

Another problem is uneven water velocities. While the large inlet offset and bypass tube solve the drainage problem, the large offset creates an uneven distribution of water velocities. When presented to the inlet of the impeller, these uneven velocities degrade pump performance significantly.

Thus, there is a need for a pump casing that can be used with a lower-speed motor, with an inlet offset: that can be easily molded into the pump casing; that is sufficient to permit a drain "leak" to be placed between the bottom of the pump casing and the bottom of the inlet pipe; and that does not compromise pump performance by creating uneven flow velocities.

SUMMARY OF THE INVENTION

In general, a pump casing of the present invention comprises an inlet conduit, a volute and a flow directing chamber. The inlet conduit has a first interior cross-sectional area. The volute has a hollow interior adapted to house a pump impeller. The flow directing chamber is positioned intermediate the inlet conduit and the volute. The chamber has a second interior cross-sectional area greater than the first interior cross-sectional area. The chamber has an inlet opening at a lower portion of the chamber and an outlet opening at an upper portion of the chamber. The inlet opening is in fluid communication with the inlet conduit. The outlet opening is in fluid communication with the volute. The outlet opening has a third interior cross-sectional area less than the second interior cross-sectional area.

In another aspect of the present invention, a pump casing comprises an inlet conduit having an upstream opening and a downstream opening, a volute having a hollow interior adapted to house a pump impeller, and a flow directing chamber positioned intermediate the inlet conduit and the volute. The inlet conduit is adapted for directing a flow of fluid along a generally longitudinal linear first flow path from the upstream opening to the downstream opening. The inlet conduit has a first interior cross-sectional area. The chamber has an inlet opening in fluid communication with the downstream opening of the inlet conduit and an outlet opening in fluid communication with the interior of the volute. The chamber has a second interior cross-sectional area greater than the first interior cross-sectional area. The outlet opening of the chamber is laterally offset from the first flow path. The chamber includes a front wall adjacent the inlet opening and a generally cylindrical peripheral wall extending from the front wall toward the volute. The front wall and peripheral wall are adapted to direct the flow of fluid received from the inlet conduit toward the outlet opening of the chamber along a generally linear second flow path. The second flow path is generally parallel to the first flow path.

In yet another aspect of the present invention, a pump comprises an impeller, a volute, and an annular seal. The impeller has an impeller body and a hollow hub extending axially from a central portion of the impeller body. The volute has a hollow interior configured for housing the impeller in a manner to permit rotation of the impeller relative to the volute. The volute has an inlet opening sized to receive at least a portion of the hollow hub of the impeller. The annular seal is connected to the volute adjacent the inlet opening. The seal has an annular groove adapted to receive an annular distal end of the hollow hub of the impeller in a manner to limit fluid leakage through the seal.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
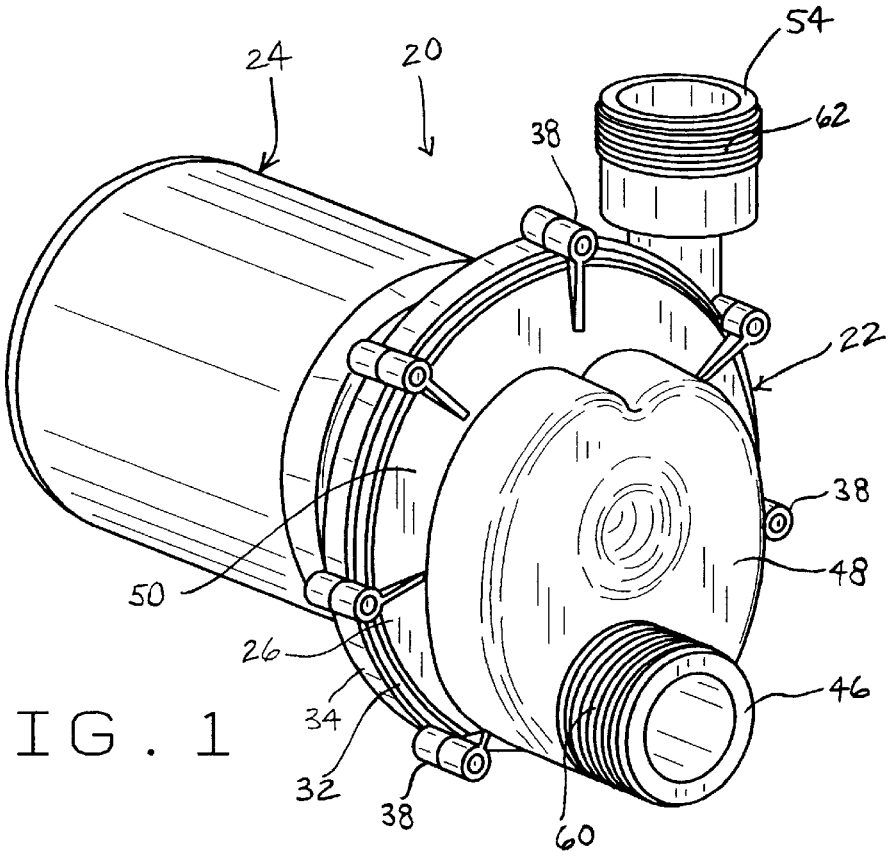
FIG. 1 is a perspective view of a pump assembly of the present invention.
Figure 2:
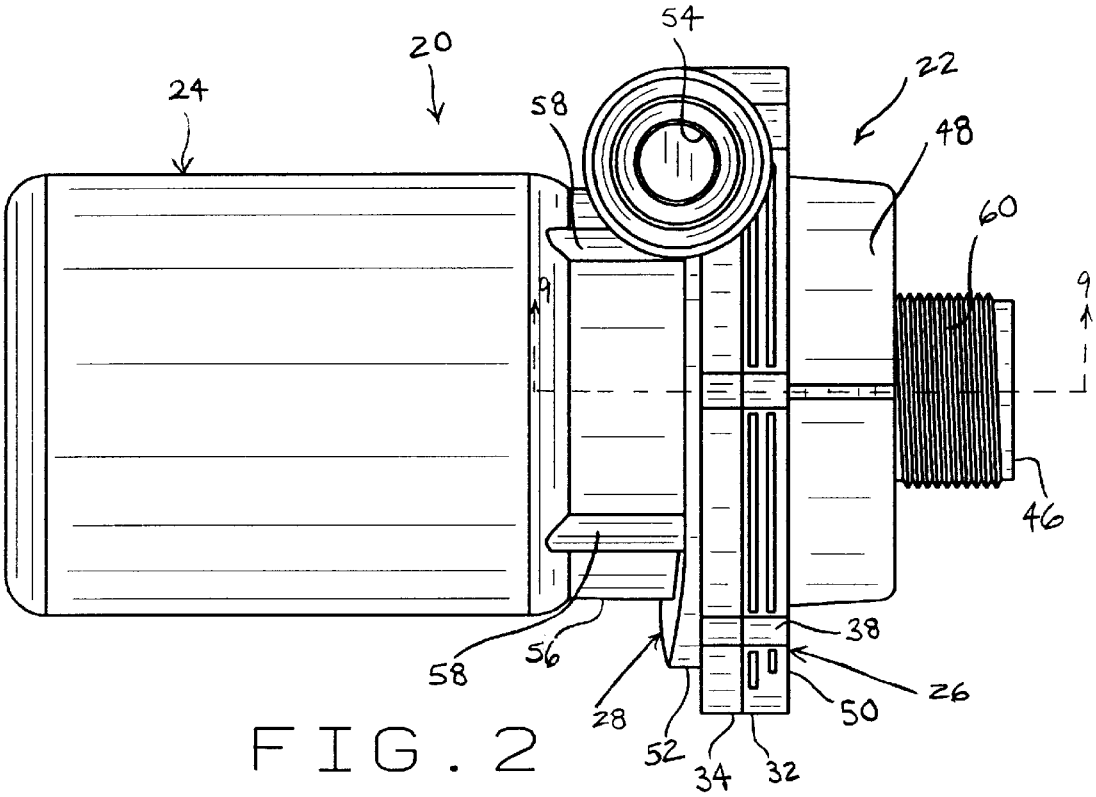
FIG. 2 is a top plan view of the pump assembly of FIG. 1.
Figure 3:
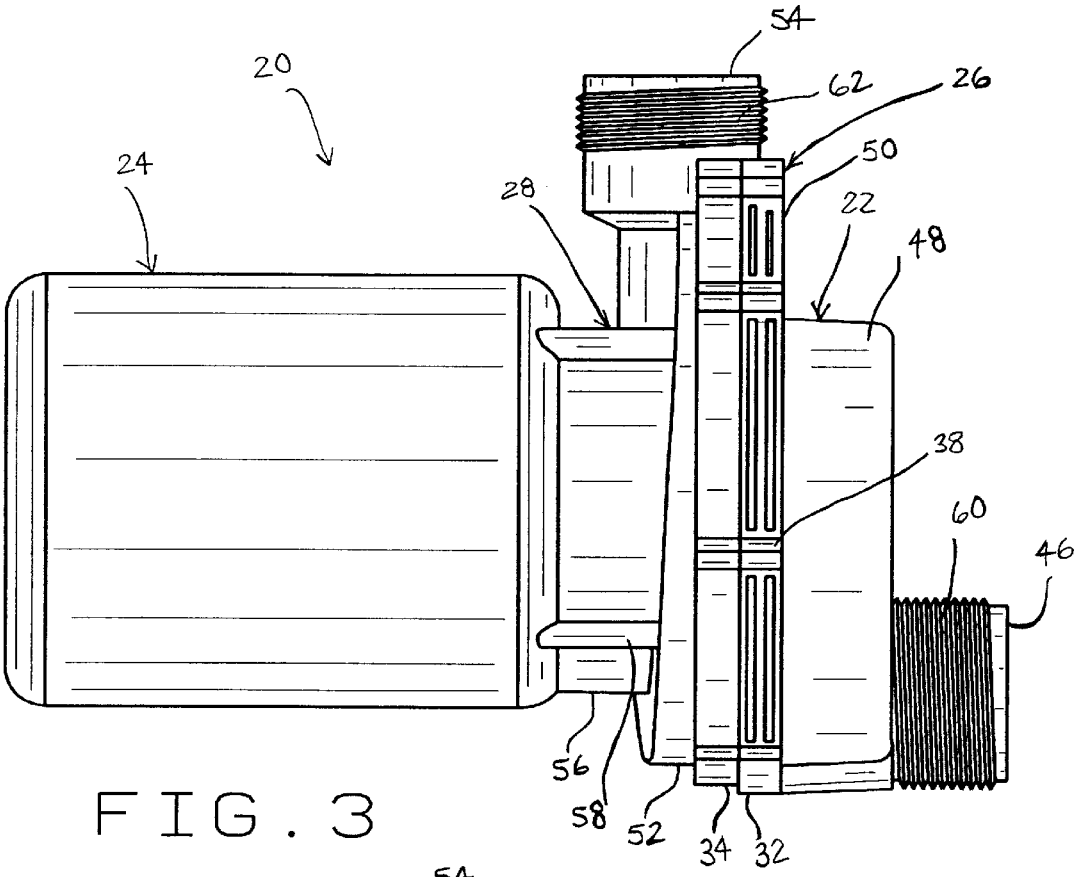
FIG. 3 is a left side elevational view of the pump assembly of FIG. 1.
Figure 4:
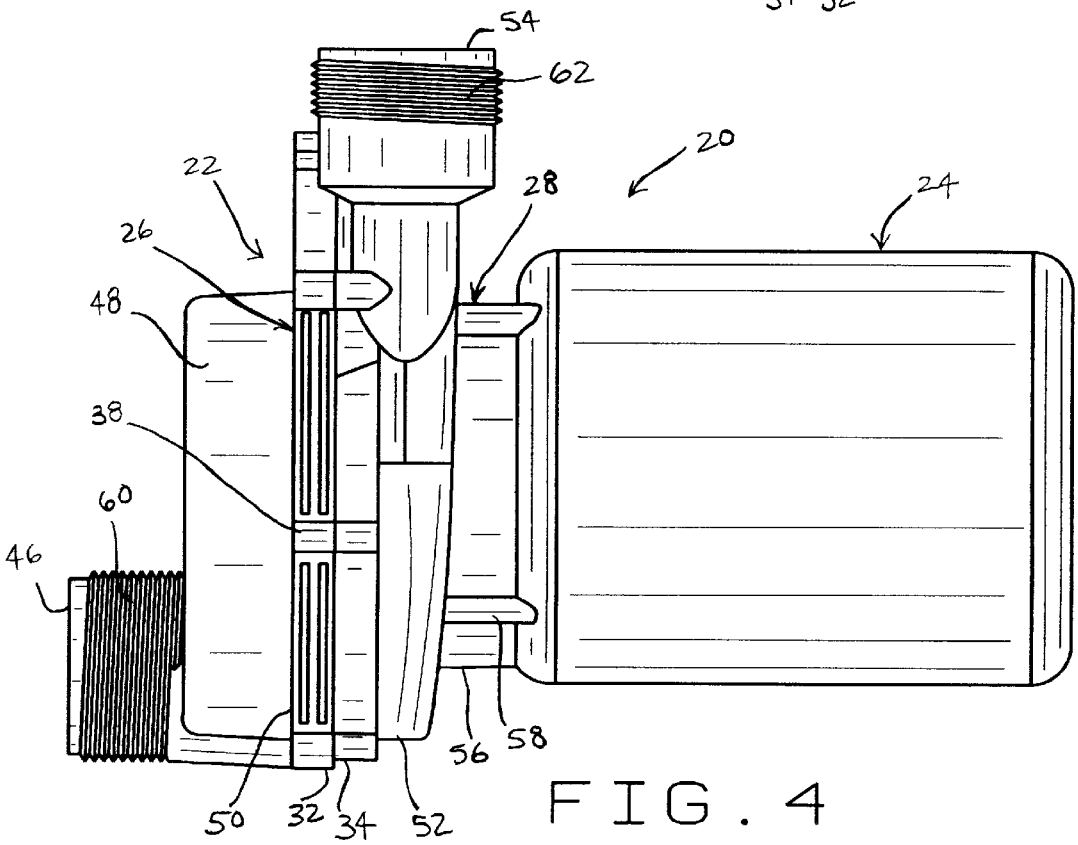
FIG. 4 is a right side elevational view of the pump assembly of FIG. 1.

A pump assembly of the present invention is represented in its entirety by the reference numeral 20 in FIGS. 1–4. In general, the pump assembly 20 includes a pump casing 22 and an electric motor 24. As shown in FIGS. 1–4, the pump casing 22 comprises a front casing section 26 and a rear casing section 28. The front casing section 26 includes a first flange 32 and the rear casing section 28 includes a second flange 34 adapted for flush engagement with the first flange 32 for joining the front casing section 26 with the rear casing section 28. Both of the first and second flanges 32 and 34 include a plurality of bosses 38 about their respective peripheries to facilitate assembly of the front and rear casing sections 26 and 28 with mechanical fasteners (not shown), such as threaded bolts. The electric motor 24 is standard. Preferably, the electric motor is a fractional horsepower motor, which operates at less than about 2000 rpm. However, depending on the requirements of a particular application, motors that operate at different speeds may be used without departing from the scope of the invention.

Figure 6:
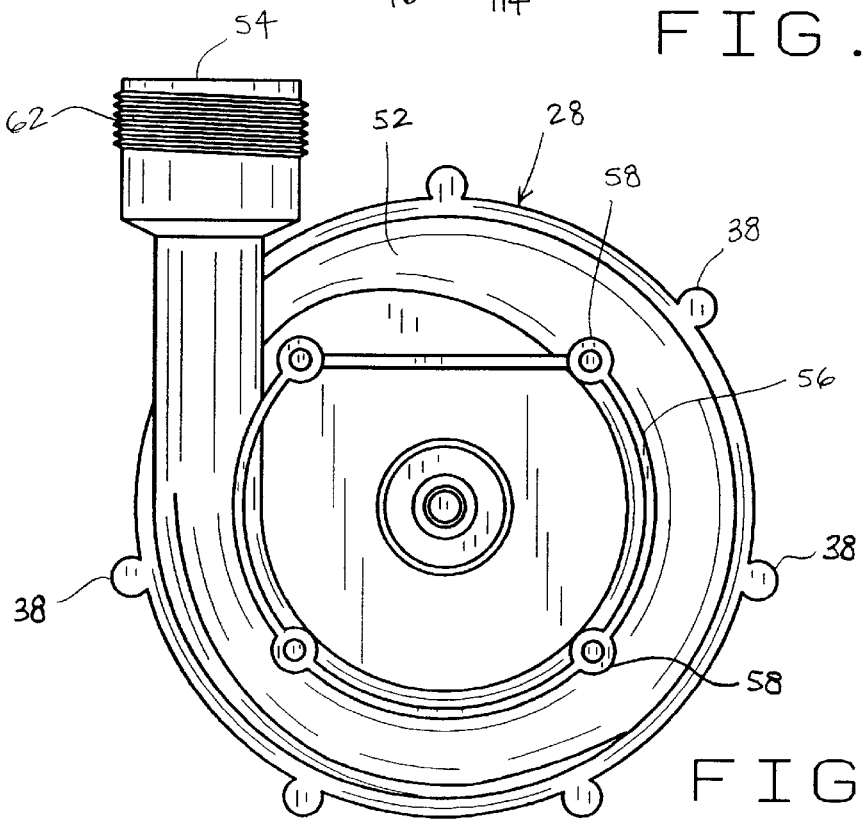
FIG. 6 is a rear elevational of view of the pump casing of the assembly, with the motor removed therefrom.

The front casing section 26 includes an inlet conduit 46, a flow directing chamber 48 and a rearward portion 50 adjacent the first flange 32. Preferably, the inlet conduit 46, flow directing chamber 48 and rearward portion 50 of the front section 26 are integral with one another, and more preferably these components are of a monolithic construction. The rear casing section 28 includes a forward portion 52 adjacent the second flange 34, an outlet conduit 54 extending outwardly from the forward portion 52 and a generally cylindrical shaft coupling enclosure 56. As shown in FIG. 6, the coupling enclosure 56 preferably includes a plurality of bosses 58 about its periphery to facilitate assembly of the pump casing 22 and electric motor 24 with mechanical fasteners (not shown), such as threaded bolts. Preferably, the forward portion 52, outlet conduit 54 and coupling enclosure 56 of the rear casing section 28 are integral with one another, and more preferably these components are of a monolithic construction. Preferably, the front casing section 26 and rear casing section 28 are each cast as a single piece, although other methods of construction could be employed without departing from the scope of the present invention.

Preferably, the inlet conduit 46 includes a threaded exterior surface 60 to facilitate connection of the pump assembly 20 to upstream plumbing (not shown). Similarly, the outlet conduit 54 preferably includes a threaded exterior surface 62 to facilitate connection of the pump assembly 20 to downstream plumbing (not shown).

Figure 9:
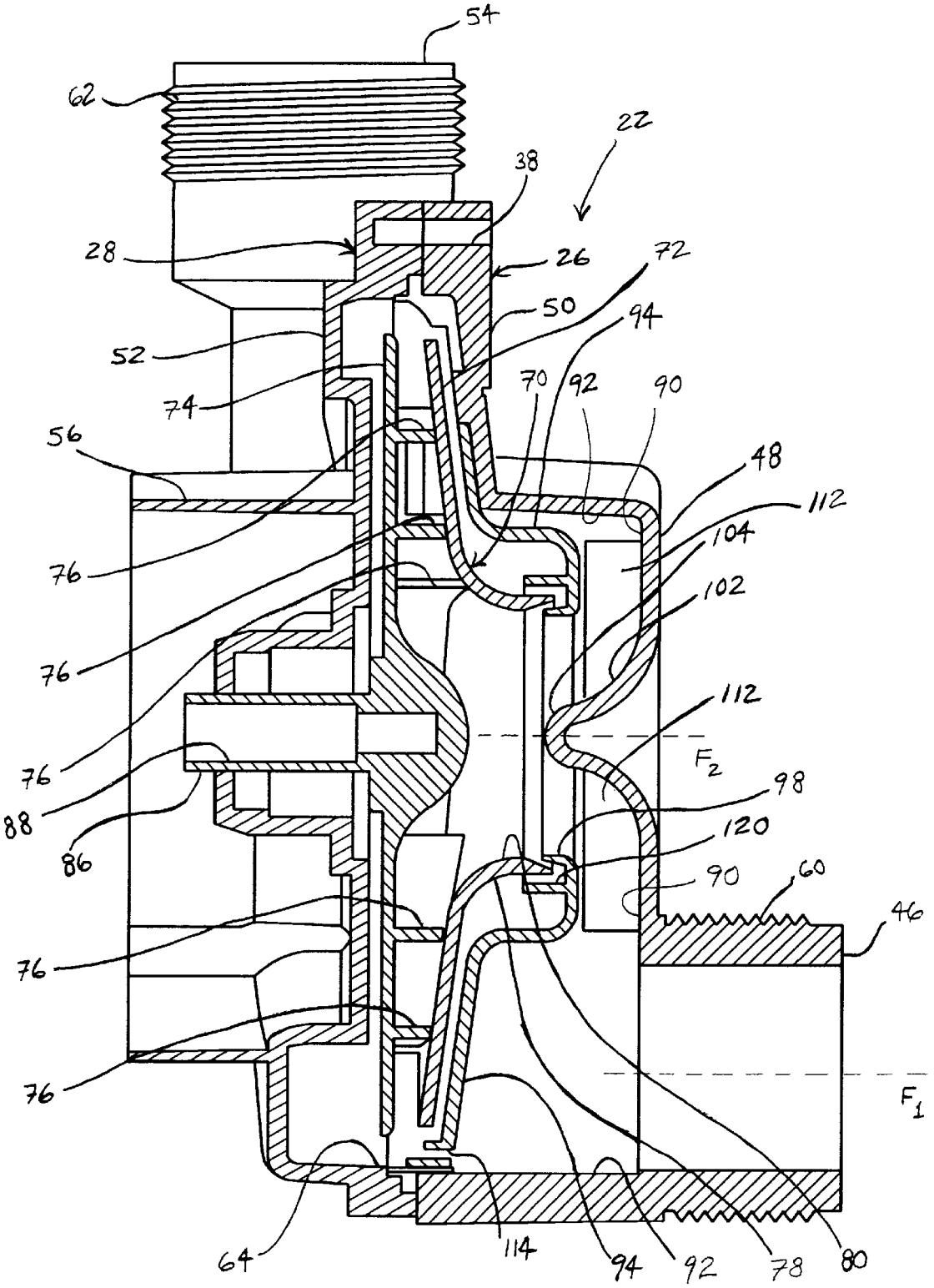
FIG. 9 is a cross-sectional side view of the pump assembly of FIGS. 1–7 taken along the plane of line 9—9 in FIG. 2.

FIG. 9 is a cross-sectional side view of the pump casing 22. As shown in FIG. 9, the rearward portion 50 of the front casing section 26 and the forward portion 52 of the rear casing section 28 define a volute 64 when the front and rear casing sections 26 and 28 are assembled with one another. The volute 64 is sized to house an impeller 70. The impeller includes a front wall 72, a rear wall 74 and a plurality of vanes 76 between the front and rear walls 72 and 74. Preferably, the vanes 76 are arranged in a spiral-like pattern, with each vane extending curvilinearly from a central portion of the impeller 70 toward the periphery of the impeller 70. The front wall 72 of the impeller 70 includes an inlet hub 78, which projects axially from the central portion of the impeller 70 generally in an upstream direction (i.e., generally in the direction of the inlet conduit 46). The inlet hub 78 includes an inlet opening 80 adapted to receive a flow of water from the inlet conduit 46. In operation, the flow travels from the inlet conduit, through the inlet opening 80 of the inlet hub 78 and into the interior of the impeller 70. The front and rear walls 72 and 74 of the impeller 70 are spaced from one another at the periphery of the impeller 70 so that water flowing through the impeller 70 is forced radially outwardly by the vanes 76 and out of the impeller 70 around its periphery. The impeller 70 also includes a rear hub 86 with an axial bore 88 adapted for receiving the motor shaft (not shown) therein. Preferably, the inlet hub 78, front wall 72, vanes 76, rear wall 74 and rear hub 86 are all integral with one another.

Thus, in operation, the electric motor 24 turns an associated motor shaft (not shown), which rotates the impeller 70. Rotation of the impeller 70 causes water to move from the central portion of the impeller 70 toward its periphery along the spiral vanes 76. Water exiting the periphery of the impeller 70 is collected in the volute 64 and then directed to the outlet conduit 54.

Figure 5:
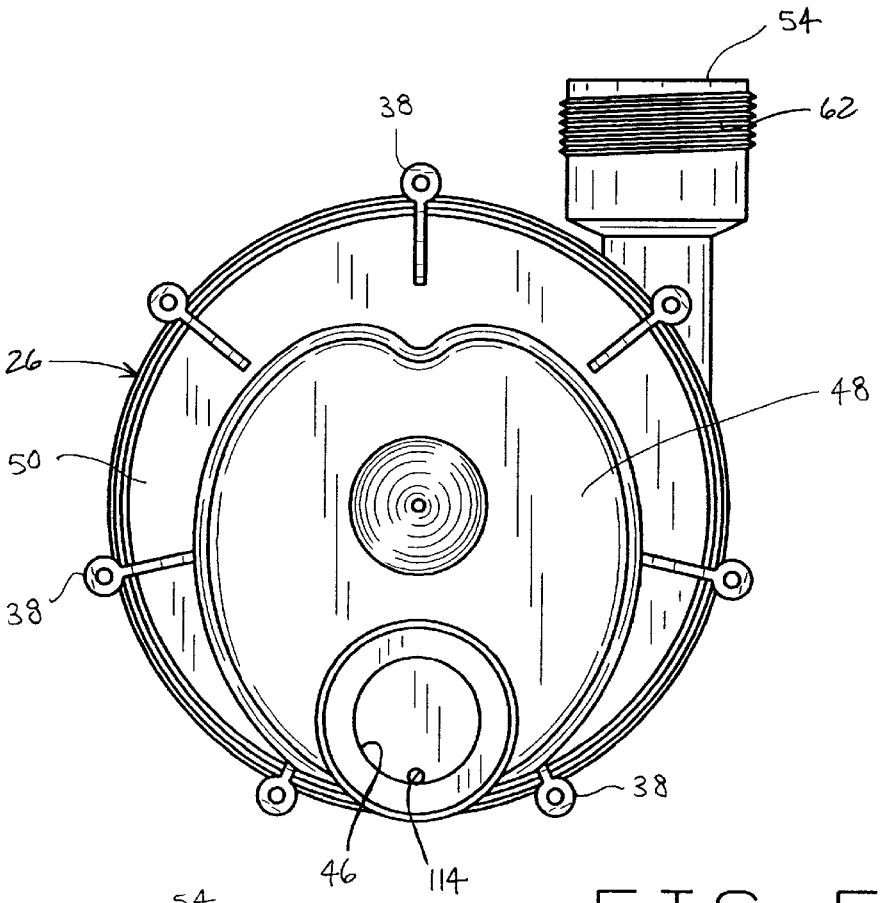
FIG. 5 is a front elevational view of the pump assembly of FIG. 1.
Figure 7:
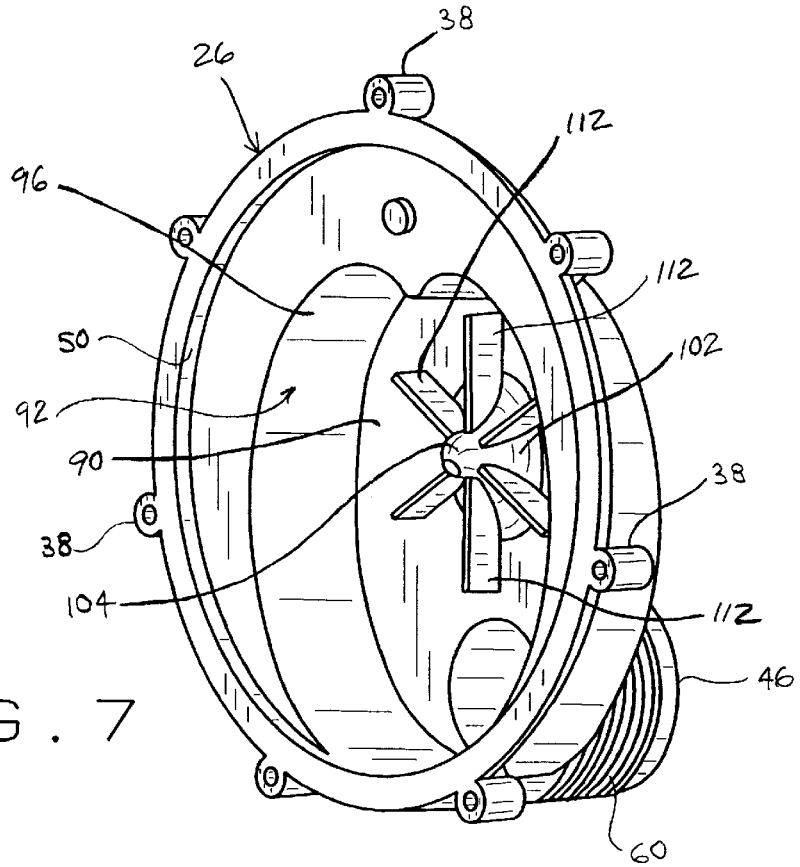
FIG. 7 is a perspective view from the rear of a front portion of the pump casing.
Figure 10:
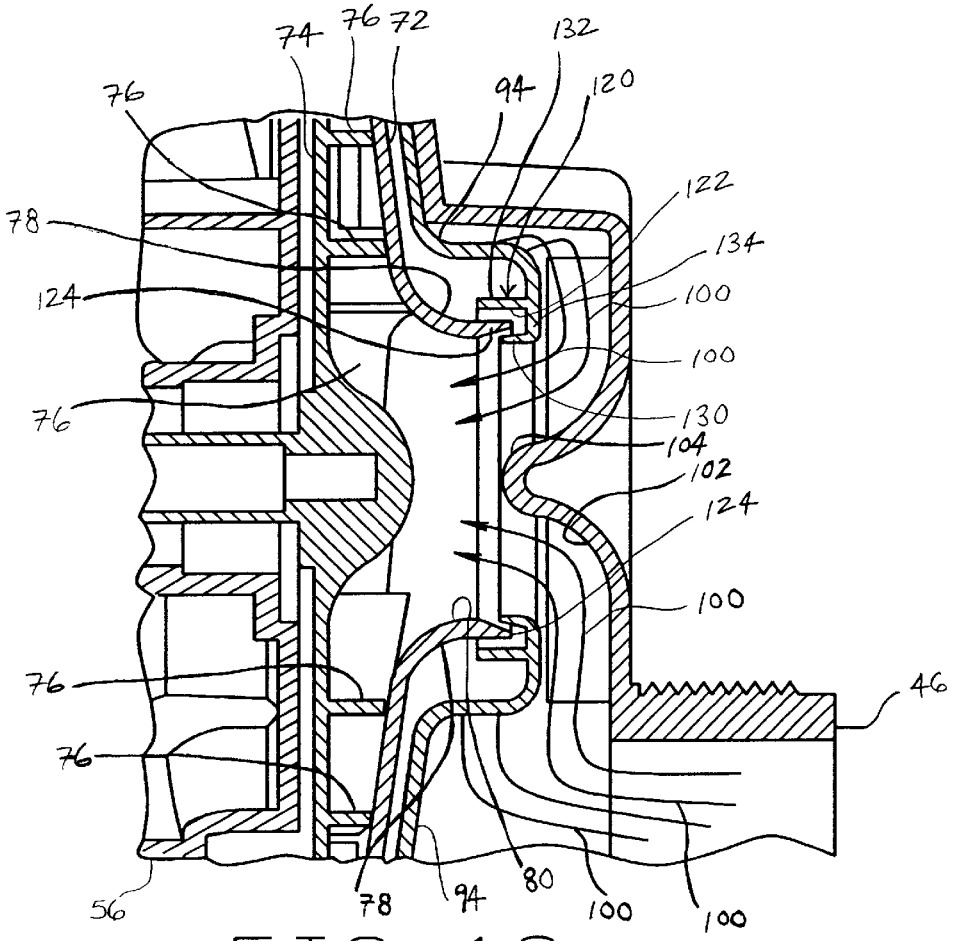
FIG. 10 is an enlarged, fragmented, cross-sectional view of the pump assembly, showing detail of the pump assembly.

The flow directing chamber 48 is positioned between the inlet conduit 46 and the impeller 70 and, as will be explained, is in fluid communication with both the inlet conduit 46 and the volute 64. As best shown in FIGS. 1, 5 and 7, the flow directing chamber 48 has a generally heart-shaped configuration. The importance of this configuration is discussed below more fully. As shown in FIG. 9, the flow directing chamber 48 is defined by a front chamber wall 90, a generally cylindrical peripheral wall 92 and a rear chamber wall 94. The peripheral wall 92 extends longitudinally from the front chamber wall 90 toward the volute 64. The peripheral wall 92 has a curved interior surface 96, which is configured to direct flow received from the inlet conduit 46 toward the upper portion of the chamber 48 along a curved path. Preferably, the curved interior surface 96 extends curvilinearly from a bottom portion of the chamber 48 adjacent the inlet conduit 46 to a top portion of the chamber 48. The rear chamber wall 94 is preferably fixedly connected to the front casing section 26 and remains stationary relative to the front casing section 26. As shown in FIGS. 9 and 10, the rear chamber wall 94 includes a chamber outlet opening 98, which is at the upper portion of the chamber 48 and which is generally in register with the inlet opening 80 of the inlet hub 78 of the impeller 70.

Figure 11:
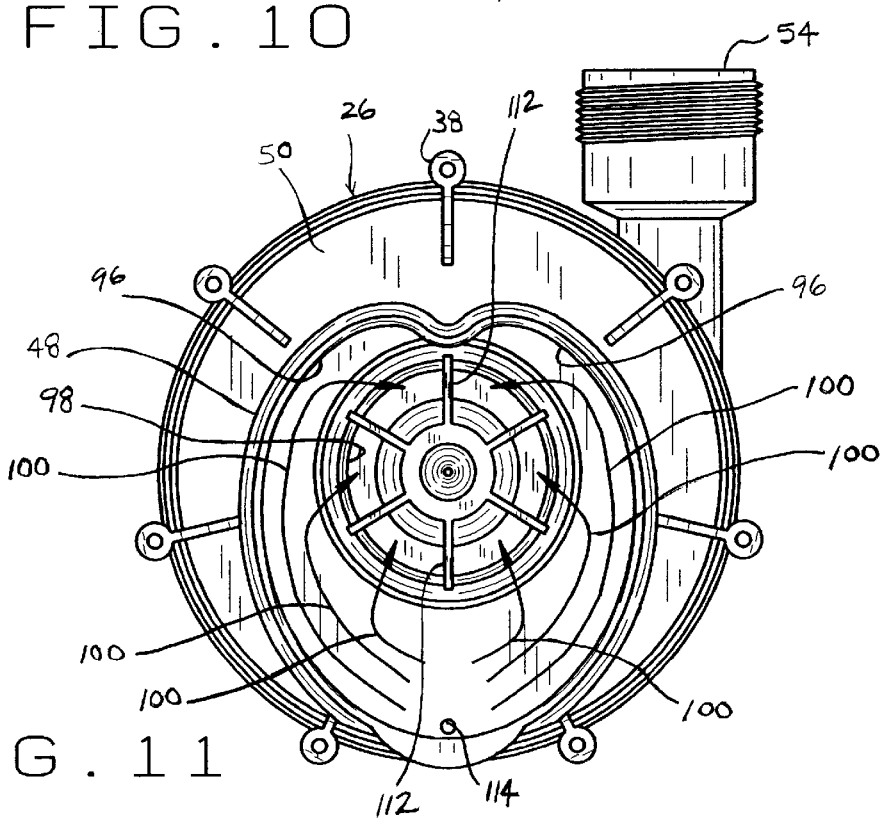
FIG. 11 is a front elevational view of the flow directing chamber, with the front wall of the chamber removed to show the flow therethrough.

The inlet conduit 46 has a first interior cross-sectional area. Preferably, the flow directing chamber 48 has a second interior cross-sectional area that is greater than the first interior cross-sectional area. Also preferably, the chamber outlet opening 98 has a third interior cross-sectional area that is less than the second interior cross-sectional area. Thus, in operation, water flowing through the inlet conduit 46 empties into a lower portion of the flow directing chamber 48. From the lower portion of the flow directing chamber 48, the flow is directed by the front chamber wall 90 and the curved interior surface 96 of the peripheral wall 92 toward the volute 64 in a manner so that the flow received from the inlet conduit 46 diverges as it enters the chamber 48 and then converges as it exits the chamber 48 through the chamber outlet opening 98. FIG. 10 is an enlarged detail view similar to FIG. 9, and FIG. 11 is a front elevational view of the flow directing chamber 48 with the front chamber wall 90 removed to show the interior of the chamber 48. The arrows 100 in FIGS. 10 and 11 represent flow patterns through the chamber 48 from the inlet conduit 46 toward the chamber outlet opening 98.

The front chamber wall 90 includes a generally conical flow directing surface 102. The conical surface 102 has an apex 104, which is pointed generally toward the chamber outlet opening 98. Preferably, the apex 104 of the conical surface 102 is generally concentric with the chamber outlet opening 98. Preferably, the curved interior surface 96 of the peripheral wall 92 of the chamber 48 is adapted to direct at least a portion of the flow from the inlet conduit 46 toward the volute 64 along a curved path around the conical surface 102 (refer again to the arrows 100 in FIGS. 10 and 11, which represent flow patterns through the chamber 48 from the inlet conduit 46 toward the chamber outlet opening 98). As shown in FIG. 10, the conical surface 102 is shaped to redirect the flow that is travelling through the chamber 48 into the chamber outlet opening 98 along a generally linear flow path.

As best shown in FIGS. 7 and 11, the chamber front wall 90 preferably includes a plurality of radial vanes 112 spaced radially from one another and extending radially outwardly from an area adjacent the apex 104 of the conical surface 102. The radial vanes 112 complement the performance of the conical surface 102 by helping to distribute the flow evenly around the conical surface 102 (see arrows 100 in FIG. 11, which represent flow patterns). The radial vanes 112 thereby help to ensure that flow enters the inlet opening 80 of the inlet hub 78 of the impeller 70 evenly and linearly (see arrows 100 in FIG. 10).

As shown in FIG. 9, the rear chamber wall 94 includes a by-pass passage 114, which is adapted for permitting fluid communication between a lower portion of the volute 64 and the lower portion of the chamber 48 and inlet conduit 46. The by-pass passage 114 allows water that would otherwise be trapped in the lower half of the volute 64 to drain back into the inlet conduit 46 when the system is drained. By comparing the pump casing 22 shown in FIG. 9 with the prior art pump casing shown in FIG. 8, it can be seen that, in the pump casing 22 of the present invention, the required length of the by-pass passage 114 is far less than in prior art pump casings.

The pump casing 22 of the present invention provides an inlet offset that maintains an even flow velocity distribution to the impeller 70 in order to maintain pump efficiency, without increasing the overall length of the pump assembly. Referring again to FIG. 9, the inlet conduit 46 is adapted for directing the flow alone a generally longitudinal linear first flow path $F_1$. The chamber outlet opening 98 is laterally offset from the first flow path $F_1$. The chamber 48 is adapted to direct the flow of fluid received from the inlet conduit 46 toward the chamber outlet opening 98 along a generally linear second flow path $F_2$. Preferably, the second flow path $F_2$ is generally parallel to the first flow path $F_1$. The conical surface 102 is adapted to redirect the flow that is travelling through the chamber 48 toward the chamber outlet opening 98 along the generally linear second flow path $F_2$. As described above, the curved interior surface 96 of the peripheral wall 92 of the chamber 48 is adapted to direct the flow from the inlet conduit 46 toward the upper portion of the chamber 48 in a manner so that the flow substantially surrounds the conical surface 102. Preferably, the conical surface 102 is adapted to redirect the flow that surrounds the conical surface 102 toward the chamber outlet opening 98 along the generally linear second flow path $F_2$.

Figure 8:
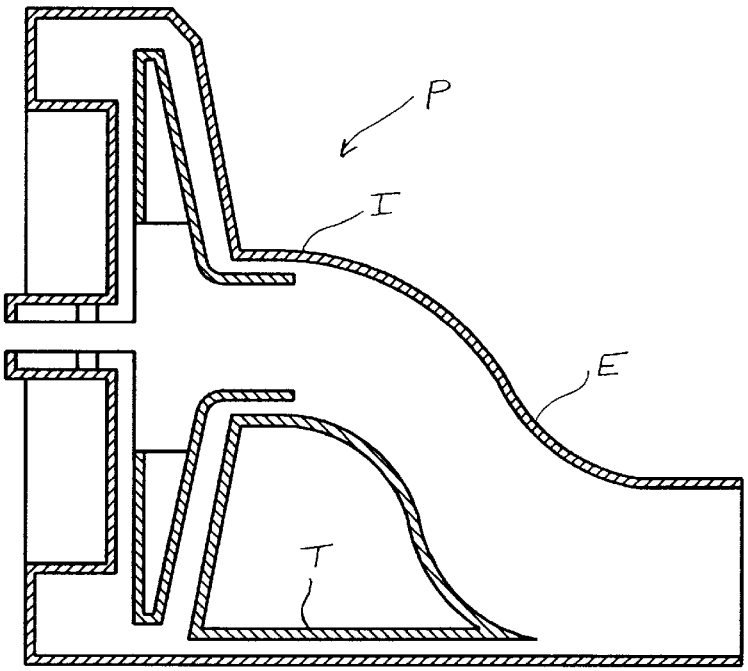
FIG. 8 PRIOR ART
FIG. 8 is a side elevational view, in cross-section, of a prior art pump assembly.

The pump assembly 22 of the present invention includes a novel sealing arrangement between the stationary rear chamber wall 94 and the impeller 70. As shown in FIG. 8, in many prior art jet pumps, no seal is employed. Thus, any fluid that is thrown back into the inlet conduit from the exterior of the impeller as the impeller rotates flows in the opposite direction of the normal flow through the inlet conduit. This tends to reduce the overall efficiency of the pump. This problem is remedied in the pump assembly 20 of the present invention. As shown in FIG. 10, the rear chamber wall 94 includes an annular seal 120 adjacent the chamber outlet opening 98. The annular seal 120 has an annular groove 122. The annular groove 122 is adapted to receive an annular distal end 124 of the inlet hub 78 of the impeller 70 in a manner to limit fluid leakage through the seal 120. The fit between the annular distal end 124 of the inlet hub 78 and the annular seal 120 is necessarily loose, since the impeller 70 rotates relative to the rear chamber wall 94. Nevertheless, the annular seal 120 results in lower fluid leakage as compared to prior art pump assemblies, without complicating assembly.

As shown in FIG. 10, inlet hub 78 extends axially from the impeller 70 in an upstream direction, and the open end of the annular groove 122 faces the downstream direction. Preferably, the annular groove 122 has a generally U-shaped cross-sectional configuration defined by an inside wall 130, an outside wall 132 spaced from the inside wall, and a bottom wall 134 connecting the inside and outside walls 130 and 132 to one another. The outside wall 132, bottom wall 134 and inside wall 130 of the seal 120 are shaped to direct any fluid that leaks through the seal 120 from an area exterior the inlet hub 78 into the inlet opening 80 of the inlet hub 78 in the downstream direction. Essentially, any fluid that leaks through the seal 120 from an area exterior the inlet hub 78 is forced to take a "U-turn" through the seal 120. Any fluid leaking through the seal 120 must first pass between the outside wall 132 and the exterior surface of the inlet hub 78. From there, the fluid is directed radially inwardly between the bottom wall 134 and the annular distal end 124 of the inlet hub 78. Then, the fluid is directed generally in the downstream direction between the inside wall 130 and the interior surface of the inlet hub 78. Thus, the annular seal 120 decreases leakage flow because the leakage path is more tortuous than in prior art pump assemblies, and any fluid that does leak past through the seal 120 is redirected in the same direction as normal flow through the pump assembly.

In view of the above, it can be seen that the pump assembly of the present invention overcomes disadvantages of the prior art and achieves other advantageous results. Although the above description is of the preferred embodiments of the pump assembly 20 of the present invention, other alternative embodiments could be provided, and other uses of the pump could be made, without departing from the scope of the invention. As various changes could be made without departing from the scope of the invention, it is intended that all matter contained in the above description or shown in the accompanying drawings shall be interpreted as illustrative and not in a limiting sense.

What is claimed is:

1. A pump casing comprising:

an inlet conduit having a first interior cross-sectional area;

a volute having a hollow interior adapted to house a pump impeller; and a flow directing chamber intermediate the inlet conduit and the volute, the chamber having a second interior cross-sectional area greater than the first interior cross-sectional area, the chamber having an inlet opening at a lower portion of the chamber and an outlet opening at an upper portion of the chamber, the inlet opening is in fluid communication with the inlet conduit, the outlet opening is in fluid communication with the volute, the outlet opening having a third interior cross-sectional area less than the second interior cross-sectional area, the chamber having a front wall adjacent the inlet opening and a generally cylindrical peripheral wall extending from the front wall toward the volute, the front wall and peripheral wall being adapted to direct a flow of fluid from the inlet conduit to the volute, the front wall having a generally conical flow directing surface with an apex pointed toward the outlet opening of the chamber.

2. The pump casing of claim 1 wherein the front wall and peripheral wall are adapted to direct a flow of fluid from the inlet conduit to the volute in a manner so that the flow received from the inlet conduit diverges as it enters the chamber through the inlet opening and converges as it exits the chamber through the outlet opening.

3. The pump casing of claim 1 further comprising a by-pass passage adapted for permitting fluid communication between a lower portion of the volute and the lower portion of the chamber.

4. The pump casing of claim 3 wherein the lower portion of chamber is generally level with the lower portion of the volute.

5. The pump casing of claim 1 wherein the generally cylindrical peripheral wall of the chamber includes a curved flow directing portion adapted to direct at least a portion of the flow from the inlet conduit to the upper portion of the chamber along a curved path.

6. The pump casing of claim 5 wherein the curved flow directing portion of the peripheral wall of the chamber extends curvilinearly from a bottom portion of the inlet opening of the chamber to a top portion of the outlet opening of the chamber.

7. The pump casing of claim 6 wherein the chamber has a generally heart-shaped configuration.

8. The pump casing of claim 1 wherein the apex of the conical surface is generally concentric with the outlet opening of the chamber.

9. The pump casing of claim 1 wherein the curved flow directing portion of the peripheral wall of the chamber is adapted to direct at least a portion of the flow from the inlet conduit to the volute along a curved path around the conical surface.

10. The pump casing of claim 1 wherein the conical surface is adapted to redirect the portion of the flow that is travelling through the chamber along a curved path toward the outlet opening of the chamber along a generally linear flow path.

11. The pump casing of claim 1 wherein the inlet conduit is adapted for directing a flow of fluid along a generally longitudinal linear first flow path, the outlet opening of the chamber being laterally offset from the first flow path, the chamber being adapted to direct the flow of fluid received from the inlet conduit toward the outlet opening of the chamber along a generally linear second flow path, the second flow path being generally parallel to the first flow path.

12. A pump casing comprising:

an inlet conduit having an upstream opening and a downstream opening, the inlet conduit being adapted for directing a flow of fluid along a generally longitudinal linear first flow path from the upstream opening to the downstream opening;

a volute having a hollow interior adapted to house a pump impeller; and a flow directing chamber intermediate the inlet conduit and the volute, the chamber having an inlet opening in fluid communication with the downstream opening of the inlet conduit and an outlet opening in fluid communication with the interior of the volute, the outlet opening of the chamber being offset from the first flow path, the chamber including a front wall adjacent the inlet opening and a generally cylindrical peripheral wall extending from the front wall toward the volute, the front wall and peripheral wall being adapted to direct the flow of fluid received from the inlet conduit toward the outlet opening of the chamber along a generally linear second flow path, the second flow path being generally parallel to the first flow path, the front wall of the chamber including a generally conical flow directing surface with an apex pointed toward the outlet opening of the chamber.

13. The pump casing of claim 12 further comprising a by-pass passage adapted for permitting fluid communication between a lower portion of the volute and a lower portion of the chamber.

14. The pump casing of claim 13 wherein the lower portion of chamber is generally level with lower portion of volute.

15. The pump casing of claim 12 further comprising a by-pass passage adapted for permitting fluid communication between a lower portion of the volute and the inlet conduit.

16. The pump casing of claim 12 wherein the generally cylindrical peripheral wall of the chamber includes a curved flow directing portion adapted to direct at least a portion of the flow from the inlet conduit toward an upper portion of the chamber along a curved path.

17. The pump casing of claim 16 wherein the curved flow directing portion of the peripheral wall of the chamber extends curvilinearly from a bottom portion of the inlet opening of the chamber to a top portion of the outlet opening of the chamber.

18. The pump casing of claim 17 wherein the chamber has a generally heart-shaped configuration.

19. The pump casing of claim 12 wherein the apex of the conical surface is generally concentric with the outlet opening of the chamber.

20. The pump casing of claim 16 wherein the curved flow directing portion of the peripheral wall of the chamber is adapted to direct at least a portion of the flow from the inlet conduit toward the upper portion of the chamber along a curved path around the conical surface.

21. The pump casing of claim 20 wherein the conical surface is adapted to redirect the portion of the flow that is travelling through the chamber along the curved path toward the outlet opening of the chamber along the generally linear second flow path.

22. The pump casing of claim 20 wherein the curved flow directing portion of the peripheral wall of the chamber is adapted to direct the flow from the inlet conduit toward the upper portion of the chamber in a manner so that the flow surrounds the conical surface.

23. The pump casing of claim 22 wherein the conical surface is adapted to redirect the flow that surrounds the conical surface toward the outlet opening of the chamber along the generally linear second flow path.

24. The pump casing of claim 12 wherein the front wall and peripheral wall of the chamber are adapted to direct the flow of fluid from the inlet conduit toward the volute in a manner so that the flow received from the inlet conduit diverges as it enters the chamber through the inlet opening.

25. The pump casing of claim 24 wherein the outlet opening of the chamber has a third interior cross-sectional area less than the second interior cross-sectional area, the front wall and peripheral wall of the chamber being adapted to direct the flow of fluid toward the volute in a manner so that the flow converges as it exits the chamber through the outlet opening.

26. A pump comprising:

an inlet conduit;

an impeller;

a volute having a hollow interior configured for housing the impeller in a manner to permit rotation of the impeller relative to the volute, the volute having an inlet opening; and a flow directing chamber intermediate the inlet conduit and the volute, the chamber having an inlet opening at a lower portion of the chamber in fluid communication with the inlet conduit, the chamber having an outlet in fluid communication with the volute, the chamber having a front wall and a generally cylindrical peripheral wall extending from the front wall toward the volute, the front wall and peripheral wall being adapted to direct a flow of fluid from the inlet conduit to the volute, the front wall having a generally conical flow directing surface with an apex pointed toward the outlet opening of the chamber.

27. The pump of claim 26 wherein the generally cylindrical peripheral wall of the chamber includes a curved flow directing portion adapted to direct at least a portion of the flow from the inlet conduit to the chamber along a curved path.

28. The pump of claim 27 wherein the curved flow directing portion of the peripheral wall of the chamber extends curvilinearly from a bottom portion of the inlet opening of the chamber to a top portion of the outlet opening of the chamber.

29. The pump of claim 28 wherein the chamber has a generally heart-shaped configuration.

30. The pump of claim 27 wherein the apex of the conical surface is generally concentric with the outlet opening of the chamber.

31. The pump of claim 27 wherein the curved flow directing portion of the peripheral wall of the chamber is adapted to direct the flow from the inlet conduit toward the upper portion of the chamber in a manner so that the flow surrounds the conical surface.

32. The pump of claim 31 wherein the conical surface is adapted to redirect the flow that surrounds the conical surface toward the outlet opening of the chamber.

33. The pump of claim 26 further comprising a by-pass passage adapted for permitting fluid communication between a lower portion of the volute and the lower portion of the chamber.

* * * * *